US010059104B2

(12) United States Patent
Yamazaki et al.

(10) Patent No.: US 10,059,104 B2
(45) Date of Patent: Aug. 28, 2018

(54) LIQUID JET HEAD AND LIQUID JET RECORDING DEVICE

(71) Applicant: SII Printek Inc., Chiba-shi, Chiba (JP)

(72) Inventors: Shunsuke Yamazaki, Chiba (JP); Naohiro Tomita, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/704,755

(22) Filed: Sep. 14, 2017

(65) Prior Publication Data

US 2018/0086065 A1 Mar. 29, 2018

(30) Foreign Application Priority Data

Sep. 29, 2016 (JP) ..... 2016-190822

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2002/14362* (2013.01); *B41J 2202/19* (2013.01)

(58) Field of Classification Search
CPC .... B41J 2/1433; B41J 2/1623; B41J 2202/19; B41J 2002/14362; B41J 2002/14443
See application file for complete search history.

(56) References Cited

U.S. PATENT DOCUMENTS 6,733,684 B2 * 5/2004 Silverbrook ..... B41J 2/1433 216/27
2002/0105567 A1 8/2002 Yamada et al.
2012/0113189 A1 5/2012 Kobayashi et al.
2015/0158301 A1 6/2015 Togashi

FOREIGN PATENT DOCUMENTS

JP H09-300633 A 11/1997
JP 2009-034862 A 2/2009
JP 2009-056601 A 3/2009
JP 2013-169749 A 9/2013

* cited by examiner

*Primary Examiner* — Julian Huffman
*Assistant Examiner* — Michael Konczal
(74) *Attorney, Agent, or Firm* — Brinks Gilson & Lione

(57) ABSTRACT

There is provided a liquid jet head capable of preventing a damage of an actuator plate without degrading the quality of characters and images to be recorded on a recording medium. The liquid jet head includes a nozzle plate, an actuator plate provided with an exposed area exposed from the nozzle plate, a nozzle guard provided with an opening section, and a bonding layer disposed at least between the actuator plate including the exposed area and the nozzle guard and bonding the actuator plate and the nozzle guard to each other. The nozzle guard includes a non-contact section continuing throughout an area from a place opposed to the exposed area to an inner circumferential edge of the opening section, and opposed to the actuator plate across the bonding layer, and an alignment section disposed on the opposite side to the non-contact section across the opening section, and carrying out the alignment between the nozzle plate and the nozzle guard.

8 Claims, 11 Drawing Sheets

LIQUID JET HEAD AND LIQUID JET RECORDING DEVICE

RELATED APPLICATIONS

This application claims priority under 35 U.S.C. § 119 to Japanese Patent Application No. 2016-190822 filed on Sep. 29, 2016, the entire content of which is hereby incorporated by reference.

FIELD OF THE INVENTION

The present invention relates to a liquid jet head and a liquid jet recording device.

BACKGROUND ART

A liquid jet recording device (in inkjet printer) for carrying out a variety of types of printing is provided with a conveyer for conveying a recording medium, a liquid jet head (an inkjet head), and a scanner for making the liquid jet head run in a direction perpendicular to the conveying direction of the recording medium. The liquid jet head supplies the liquid jet head with ink (a liquid) from a liquid container (an ink tank) via a liquid supply pipe (an ink supply pipe), and ejects the ink from a jet orifice (a nozzle hole) of a head chip provided to the liquid jet head toward the recording medium. Thus, characters and images are recorded on the recording medium.

The head chip is provided with a jet orifice plate (a nozzle plate) with the jet orifice formed, and an actuator plate, which is bonded to the jet orifice plate, and has a plurality of channels communicated with the jet orifice. Each of the channels of the actuator plate is filled with the ink. In many cases, the jet orifice plate is formed of resin in order to process the jet orifice with high accuracy. In contrast, the actuator plate is formed of a piezoelectric material such as PZT (lead zirconate titanate). In such a configuration, when applying a voltage to the actuator plate, the capacity of the channel varies due to a piezoelectric shear effect. The ink is ejected through the jet orifice using this variation.

The liquid jet head configured in such a manner as described above is attached to the scanner via a base plate including a fixation plate and a head cover (see, e.g., JP-A-2009-34862). In attaching the liquid jet head to the base plate, the liquid jet head is attached so that the jet orifice plate bonded to the head chip and the base plate are bonded to each other.

Incidentally, the head chip needs to be aligned to the base plate for alignment to the scanner. Therefore, there is developed a technology of providing a rib, which projects from a place (a jet orifice guard) opposed to the jet orifice plate in the base plate toward the jet orifice plate, and has contact with the jet orifice plate. The head chip is fixed to the base plate via an adhesive disposed between the head chip and another part of the base plate than the rib while having contact with the rib of the base plate.

Here, if the material of the jet orifice plate and the material of the actuator plate are different from each other, the expansion deformation amount and the contraction deformation amount due to the variation in heat are also different therebetween. Due to the difference in deformation amount, a warpage occurs in the actuator plate. If the warpage occurs in the actuator plate, stress is applied to the adhesive located between the head chip and the base plate. However, since the base plate is provided with the rib having contact with the jet orifice plate, the adhesive sandwiched between the head chip and the base plate is limited in expansion/contraction deformation by the rib, and it becomes difficult to release the stress. As a result, the warpage of the actuator plate is restricted, and the actuator plate also fails to release the stress, and the stress in the actuator plate increases.

Moreover, the actuator plate is provided with the plurality of channels, and is therefore made weak (easy to be broken) against deformation. In particular, the part of the actuator plate exposed from the jet orifice plate, namely the part to which the jet orifice is not bonded, is not provided with the reinforcement by the bond with the jet orifice plate, and is therefore made particularly weak against deformation. Therefore, in the case in which the stress due to the heat variation of the actuator plate cannot be released to increase the stress, there is a possibility that the actuator plate is damaged.

Therefore, the invention is to provide a liquid jet head and a liquid jet recording device capable of preventing the damage of the actuator plate without degrading the quality of characters and images to be recorded on the recording medium.

SUMMARY

A liquid jet head according to an aspect of the invention includes a jet orifice plate provided with a jet orifice, an actuator plate attached to one surface side of the jet orifice plate, having a plurality of channels communicated with the jet orifice, and provided with an exposed area exposed from the jet orifice plate, a jet orifice guard disposed so as to cover the jet orifice plate and the actuator plate from the other surface side of the jet orifice plate, and provided with an opening section adapted to expose the jet orifice, and a bonding layer disposed at least between the actuator plate including the exposed area and the jet orifice guard, and adapted to bond the actuator plate and the jet orifice guard to each other, and the jet orifice guard includes a non-contact section continuing throughout an area from a place opposed to the exposed area to an inner circumferential edge of the opening section, and opposed to the actuator plate across the bonding layer, and an alignment section disposed on an opposite side to the non-contact section across the opening section, and adapted to carry out alignment between the jet orifice plate and the jet orifice guard.

According to this aspect of the invention, since the bonding layer is disposed between the exposed area exposed from the jet orifice plate out of the actuator plate and the jet orifice guard, it is possible to prevent the exposed area, which is not reinforced by the jet orifice plate, and is therefore weak against the deformation, from having direct contact with the jet orifice guard to be damaged when the actuator plate warps.

Moreover, since the jet orifice guard has the non-contact section continuing throughout the area from the place opposed to the exposed area of the actuator plate to the inner circumferential edge of the opening section, and opposed to the actuator plate across the bonding layer, it is possible to release the stress, which is applied to the bonding layer when the actuator plate warps, toward the inner circumferential edge of the opening section. Therefore, it is possible to release the stress in the exposed area, which is caused by the warpage of the actuator plate, through the bonding layer, and it is possible to prevent the exposed area of the actuator plate from being damaged.

Further, the jet orifice guard has the alignment section disposed on the opposite side to the non-contact section across the opening section, and carrying out the alignment between the jet orifice plate and the jet orifice guard. Thus, it is possible to accurately determine the position of the jet orifice with respect to the jet orifice guard while preventing the increase in stress of the actuator plate due to the restriction of the expansion/contraction deformation of the bonding layer disposed between the non-contact section and the actuator plate. Therefore, it is possible to prevent the degradation of the quality of the character and the figure recorded on the recording medium.

According to the configuration described above, it is possible to prevent the damage of the actuator plate without degrading the quality of the character and the figure recorded on the recording medium.

In the liquid jet head describe above, it is preferable that the non-contact section is provided with a blocking section adapted to prevent a material constituting the bonding layer from flowing into the opening section.

According to this aspect of the invention, since the material constituting the bonding layer can be prevented by the blocking section from flowing into the opening section when bonding the actuator plate and the jet orifice guard to each other, it is possible to prevent the jet orifice exposed in the opening section from being blocked by the material constituting the bonding layer. Therefore, it is possible to prevent the degradation of the quality of the character and the figure recorded on the recording medium.

In the liquid jet head describe above, it is preferable that the blocking section is a protruding section projecting toward the jet orifice plate.

According to this aspect of the invention, the flow of the material constituting the bonding layer can be restricted in the protruding section. Therefore, it is possible to prevent the material constituting the bonding layer from flowing into the opening section.

In the liquid jet head describe above, it is preferable that the blocking section is a recessed section provided to the jet orifice guard.

According to this aspect of the invention, the material constituting the bonding layer and flowing can be reserved in the recessed section. Therefore, it is possible to prevent the material constituting the bonding layer from flowing into the opening section.

In the liquid jet head describe above, it is preferable that the alignment section is at least one projection section projecting toward the jet orifice plate so as to have contact with the jet orifice plate.

According to this aspect of the invention, since the projection section projects toward the jet orifice plate so as to have contact with the jet orifice plate, it is possible to carry out the alignment between the jet orifice plate and the jet orifice guard as the alignment section.

In the liquid jet head describe above, it is preferable that the plurality of projection sections extends along an inner circumferential edge of the opening section.

According to this aspect of the invention, since the projection section extends along the inner circumferential edge of the opening section, it is possible to restrict the flow of the material constituting the bonding layer to thereby prevent the material from flowing into the opening section. Further, since the plurality of projection sections is disposed, it is possible to reserve the material constituting the bonding layer between the projection sections, and it is possible to more reliably prevent the material constituting the bonding layer from flowing into the opening section.

In the liquid jet head describe above, it is preferable that there are further included a cover plate disposed on an opposite side to the jet orifice plate across the actuator plate so as to block the plurality of channels, and a circuit board attached to the exposed area, and the channels and the jet orifice are communicated with each other in a central part in an extending direction of the plurality of channels.

According to this aspect of the invention, it is possible to preferably apply the configuration described above to the so-called side-shooting type actuator plate.

A liquid jet recording device according to another aspect of the invention includes the liquid jet head describe above, a conveyer adapted to move the liquid jet head and recording medium relatively to each other, a liquid container containing a liquid, and a liquid circulator adapted to circulate the liquid between the liquid jet head and the liquid container.

According to this aspect of the invention, since there is provided a liquid jet head described above, it is possible to provide a liquid jet recording device capable of preventing a damage of the actuator plate without degrading the quality of characters and images to be recorded on a recording medium.

According to the invention, since the bonding layer is disposed between the exposed area of the actuator plate and the jet orifice guard, it is possible to prevent the exposed area from having direct contact with the jet orifice guard to be damaged when the actuator plate warps. Moreover, since the jet orifice guard has the non-contact section, it is possible to release the stress, which is applied to the bonding layer when the actuator plate warps, toward the inner circumferential edge of the opening section. Therefore, it is possible to release the stress in the exposed area, which is caused by the warpage of the actuator plate, through the bonding layer, and it is possible to prevent the exposed area of the actuator plate from being damaged. Further, since the jet orifice guard has the alignment section disposed on the opposite side to the non-contact section across the opening section, and carrying out the alignment between the jet orifice plate and the jet orifice guard, it is possible to accurately determine the position of the jet orifice with respect to the jet orifice guard. Therefore, it is possible to prevent the degradation of the quality of the character and the figure recorded on the recording medium. Therefore, it is possible to prevent the damage of the actuator plate without degrading the quality of the character and the figure recorded on the recording medium.

DETAILED DESCRIPTION OF THE INVENTION

Some embodiments of the invention will hereinafter be described with reference to the drawings.

First Embodiment

Liquid Jet Recording Device

Figure 1:
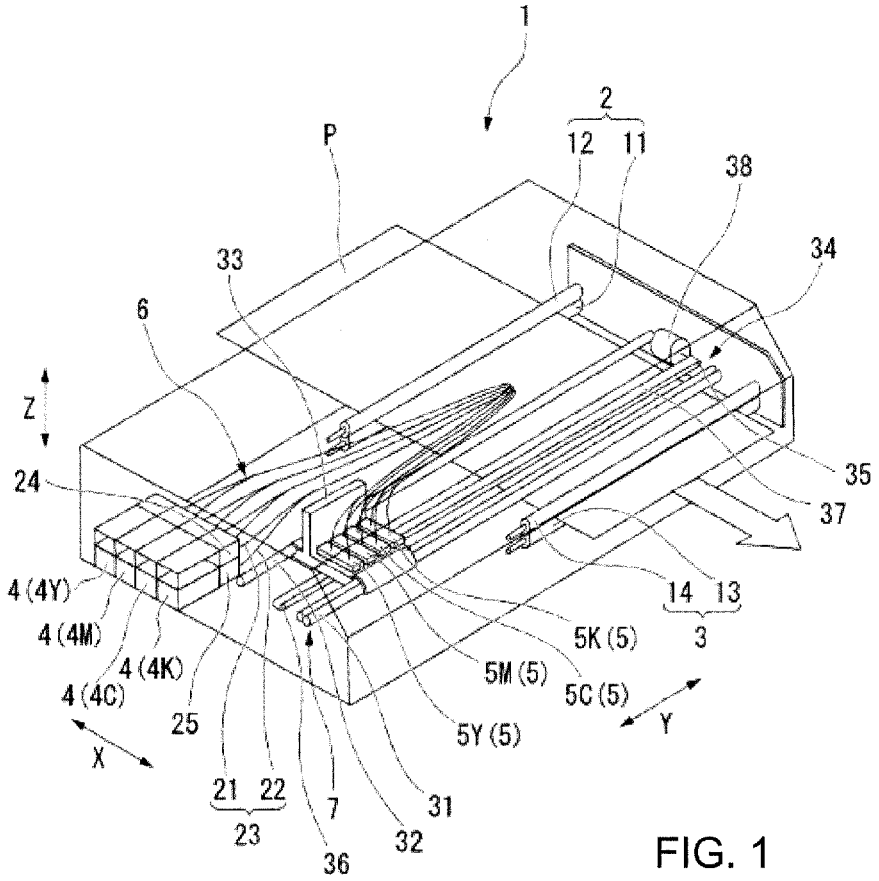
FIG. 1 is a perspective view of a liquid jet recording device according to a first embodiment of the invention.

FIG. 1 is a perspective view of a liquid jet recording device according to the first embodiment.

As shown in FIG. 1, the liquid jet recording device 1 is a so-called inkjet printer, and is provided with a pair of conveyers 2, 3 for conveying a recording medium P such as paper, liquid containers 4 each containing ink, a liquid jet head 5 for ejecting an ink droplet toward the recording medium P, a liquid circulator 6 for circulating the ink between the liquid container 4 and the liquid jet head 5, and a scanner 7 for making the liquid jet head 5 run in a direction (a sub-scanning direction) perpendicular to the conveying direction (a main scanning direction) of the recording medium P.

It should be noted that the scale size of each member is accordingly altered so that the member is shown large enough to recognize in the drawings used in the following explanation.

Further, in the following description, the main scanning direction is defined as an X direction, the sub-scanning direction is defined as a Y direction, and a direction perpendicular to both of the X direction and the Y direction is defined as a Z direction. Here, the liquid jet recording device 1 is installed so that the X direction and the Y direction are horizontal directions, and the Z direction is a vertical direction along the gravitational direction, and is then used.

In other words, there is adopted a configuration in which in the state of installing the liquid jet recording device 1, the liquid jet head 5 runs above the recording medium P along the horizontal directions (the X direction and the Y direction). Further, there is adopted a configuration in which the ink droplet is ejected from the liquid jet head 5 downward along the gravitational direction (downward along the Z direction), and then lands on the recording medium P.

The conveyer 2 is provided with a grit roller 11 extending in the Y direction, a pinch roller 12 extending in parallel to the grit roller 11, and a drive mechanism (not shown) such as a motor for making axial rotation of the grit roller 11.

Similarly, the conveyer 3 is provided with a grit roller 13 extending in the Y direction, a pinch roller 14 extending in parallel to the grit roller 13, and a drive mechanism (not shown) for making axial rotation of the grit roller 13.

As the liquid containers 4, there are disposed liquid containers 4Y, 4M, 4C, and 4K of four colors of ink of, for example, yellow, magenta, cyan, and black arranged side by side in the X direction. It should be noted that the liquid containers 4 are not limited to the liquid containers 4Y, 4M, 4C, and 4K respectively containing the four types of ink of yellow, magenta, cyan, and black, but can also be provided with ink tanks containing a larger number of colors of ink.

Figure 2:
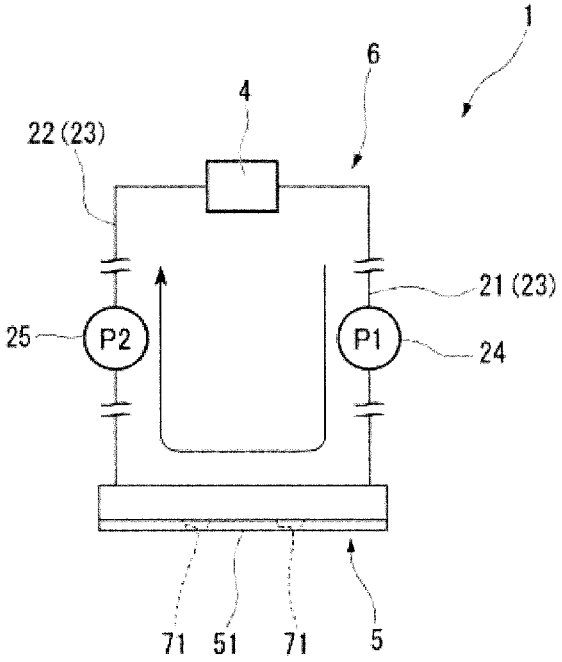
FIG. 2 is a schematic configuration diagram of a liquid jet head and a liquid circulator according to the first embodiment.

FIG. 2 is a schematic configuration diagram of the liquid jet head and the liquid circulator according to the first embodiment.

As shown in FIG. 2, the liquid circulator 6 is provided with a circulation flow channel 23 including a liquid supply pipe 21 for supplying the liquid jet head 5 with the ink, and a liquid exhaust pipe 22 for exhausting the ink from the liquid jet head 5, a pressure pump 24 connected to the liquid supply pipe 21, and a suction pump 25 connected to the liquid exhaust pipe 22. It should be noted that the liquid supply pipe 21 and the liquid exhaust pipe 22 are each formed of a flexible hose having flexibility capable of dealing with the action of the scanner 7 for supporting the liquid jet head 5.

The pressure pump 24 pressures the inside of the liquid supply pipe 21 to feed the ink to the liquid jet head 5 via the liquid supply pipe 21. Thus, the liquid supply pipe 21 is provided with the positive pressure with respect to the liquid jet head 5.

The suction pump 25 reduces the pressure in the liquid exhaust pipe 22 to suction the ink from the liquid jet head 5. Thus, the liquid exhaust pipe 22 is provided with the negative pressure with respect to the liquid jet head 5. Further, it is arranged that the ink can circulate between the liquid jet head 5 and the liquid containers 4 via the circulation flow path 23 by driving the pressure pump 24 and the suction pump 25.

Going back to FIG. 1, the scanner 7 is provided with a pair of guide rails 31, 32, a carriage 33 movably supported by the pair of guide rails 31, 32, and the drive mechanism 34 for moving the carriage 33 in the Y direction. The drive mechanism 34 is provided with a pair of pulleys 35, 36 disposed between the pair of guide rails 31, 32, an endless belt 37 wound between the pair of pulleys 35, 36, and a drive motor 38 for rotationally driving the pulley 35 as one of the pulleys 35, 36.

The pair of pulleys 35, 36 are respectively disposed between the both end parts of the pair of guide rails 31, 32. The endless belt 37 is disposed between the pair of guide rails 31, 32. To the endless belt 37, there is connected the carriage 33. On the carriage 33, there are mounted liquid jet heads 5Y, 5M, 5C, and 5K of four colors of ink of yellow, magenta, cyan, and black arranged side by side in the Y direction as the plurality of liquid jet heads 5. It should be noted that a moving mechanism for moving the liquid jet heads 5 and the recording medium P relatively to each other is constituted by the conveyers 2, 3 and the scanner 7.

Liquid Jet Head

Then, the liquid jet head 5 will be described. It should be noted that the liquid jet heads 5Y, 5M, 5C, an 5K are all constituted by the same constituents except the color of the ink to be supplied, and will therefore be explained in the following description collectively as the liquid jet head 5.

Figure 3:
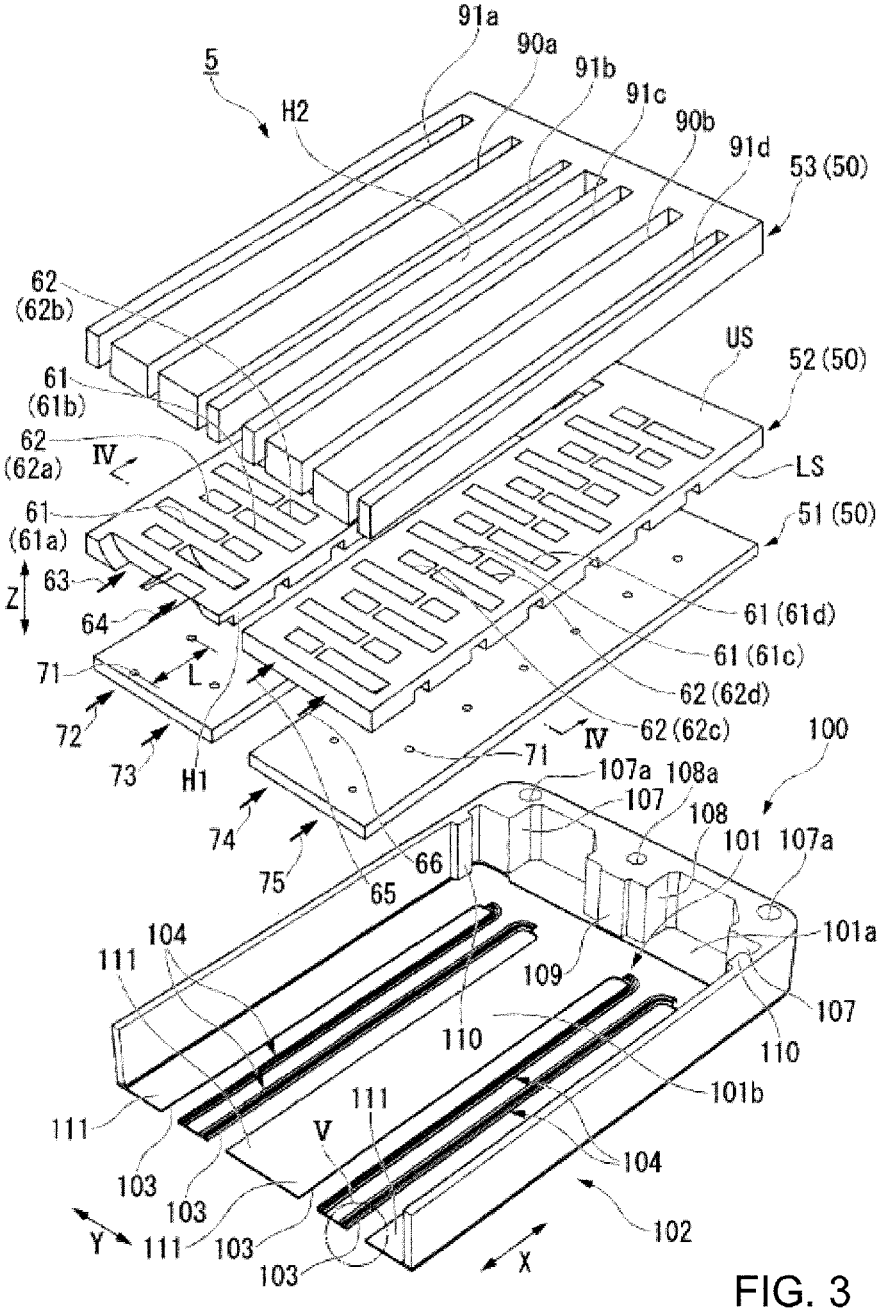
FIG. 3 is an exploded perspective view of a liquid jet head according to the first embodiment.
Figure 4:
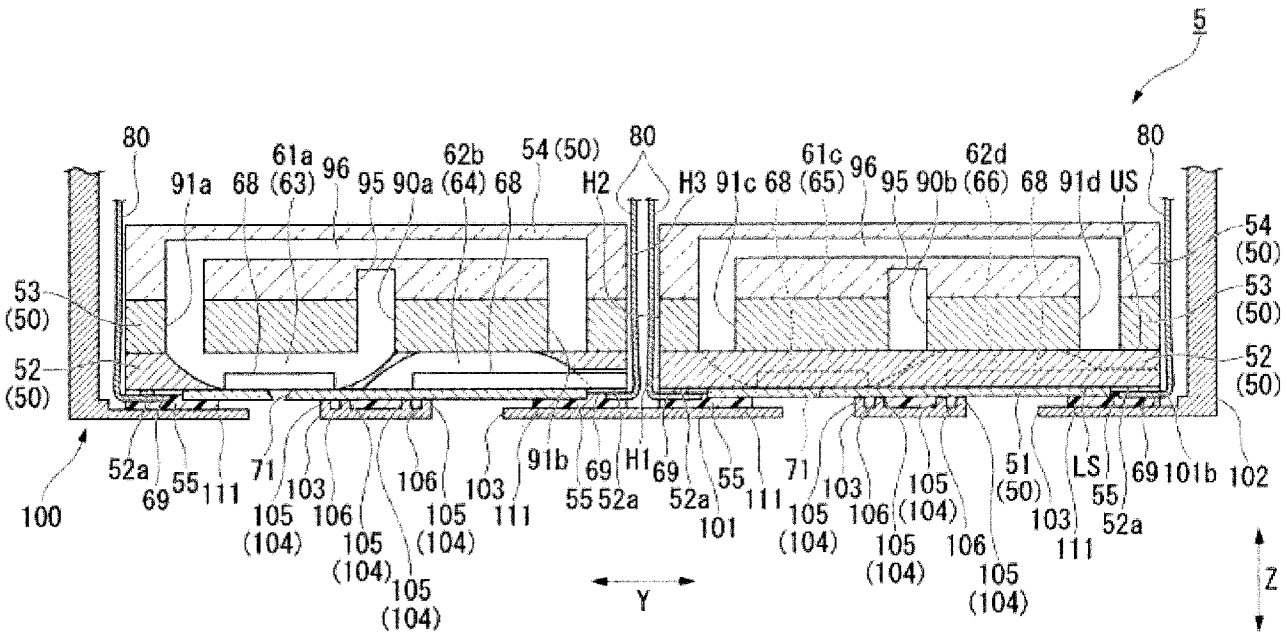
FIG. 4 is a cross-sectional view of the liquid jet head according to the first embodiment.

FIG. 3 is an exploded perspective view of the liquid jet head according to the first embodiment. FIG. 4 is an explanatory diagram of the liquid jet head according to the first embodiment, and is a diagram corresponding to a cross-section along the line IV-IV in FIG. 3 in the assembled state of the liquid jet head. It should be noted that in FIG. 3, illustration of a bonding layer 55 described later is omitted.

As shown in FIG. 3 and FIG. 4, the liquid jet head 5 is a so-called side-shooting type for ejecting the ink from a central part in the channel extending direction (the Y direction) in the ejection channel 61 described later. The liquid jet head 5 of the side-shooting type of this type is a circulation type for circulating the ink between the liquid jet head 5 and the liquid container 4.

The liquid jet head 5 is mainly provided with a head chip 50 including a nozzle plate 51 (the jet orifice plate), an actuator plate 52, a cover plate 53, and a flow channel plate 54, a circuit board 80 connected to the head chip 50, a base plate 100 for supporting the head chip 50 and fixing the liquid jet head 5 to the carriage 33, and the bonding layer 55 for bonding the head chip 50 and the base plate 100 to each other.

The head chip 50 is provided with a configuration in which the nozzle plate 51, the actuator plate 52, the cover plate 53, and the flow channel plate 54 are stacked on one another in this order along the Z direction with the adhesive. It should be noted that in the following description, among the directions along the Z direction, the direction toward the flow channel plate 54 is defined as an upper direction, and the direction toward the nozzle plate 51 is defined as a lower direction.

Actuator Plate

As shown in FIG. 3, the actuator plate 52 is a plate formed of a piezoelectric material such as PZT (lead zirconate titanate) so as to have a rectangular plate shape elongated in the X direction. The actuator plate 52 is a so-called monopole substrate the polarization direction of which is set to one direction along the thickness direction (the Z direction). In the actuator plate 52, four channel rows (a first channel row 63, a second channel row 64, a third channel row 65, and a fourth channel row 66 indicated by arrows in FIG. 3) each constituted by a plurality of channels 61, 62 formed so as to be arranged in the X direction are disposed along the Y direction.

Between the second channel row 64 and the third channel row 65, there is formed a first opening H1 penetrating the actuator plate 52 from the upper surface US to the lower surface LS thereof. It should be noted that since the basic configurations of the respective channel rows 63 through 66 are the same, in the following description, the first channel row 63 is mainly explained, and the corresponding parts in the second through fourth channel rows 64 through 66 to those in the first channel row 63 are denoted by the same reference symbols, and the description thereof will be omitted.

The plurality of channels 61, 62 are constituted by ejection channels 61 filled with the ink, and non-ejection channels 62 not filled with the ink. The ejection channels 61 and the non-ejection channels 62 are alternately arranged along the X direction.

The ejection channels 61 each penetrate the actuator plate 52 from the upper surface US to the lower surface LS thereof. The ejection channels 61 are each formed so as to project from the upper surface US toward the lower surface LS. In contrast, the non-ejection channels 62 are each formed so as to project from the lower surface LS toward the upper surface US.

Here, the ejection channels 61 and the non-ejection channels 62 included in the first channel row 63 are defined as first ejection channels 61*a* and first non-ejection channels 62*a*. Further, the ejection channels 61 and the non-ejection channels 62 included in the second channel row 64 are defined as second ejection channels 61*b* and second non-ejection channels 62*b*. Further, the ejection channels 61 and the non-ejection channels 62 included in the third channel row 65 are defined as third ejection channels 61*c* and third non-ejection channels 62*c*. Further, the ejection channels 61 and the non-ejection channels 62 included in the fourth channel row 66 are defined as fourth ejection channels 61*d* and fourth non-ejection channels 62*d*.

As shown in FIG. 3 and FIG. 4, in the first channel row 63 and the second channel row 64 adjacent to each other, an end part located on the second channel row 64 side of the first election channel 61*a* included in the first channel row 63 located on one side in the Y direction, and an end part located on the first channel row 63 side of the second non-election channel 62*b* included in the second channel row 64 located on the other side in the Y direction are separated from each other, and overlap each other in the Z direction. Further, an end part located on one side in the Y direction of the first non-ejection channel 62*a* included in the first channel row 63 is formed as a shallow groove having a constant groove depth until the groove reaches the side surface on the one side in the Y direction of the actuator plate 52.

An end part located on the other side in the Y direction of the second non-ejection channel 62*b* included in the second channel row 64 is formed as a shallow groove having a straight shape until the groove reaches the side surface of the first opening H1. In each of the shallow grooves, the depth from the lower surface LS is set to be deeper than a half of the thickness of the actuator plate 52. Substantially the same as in the first channel row 63 and the second channel row 64 also applies to the third channel row 65 and the fourth channel row 66 adjacent to each other.

By forming the ejection channels 61 and the non-ejection channels 62 as described above, the width in the Y direction of the first channel row 63 and the second channel row 64, and the width in the Y direction of the third channel row 65 and the fourth channel row 66 can be reduced.

The first ejection channels 61*a* included in the first channel row 63 are arranged in the X direction at intervals of L. The ejection channels 61*b* through 61*d* included respectively in the second through fourth channel rows 64 through 66 are also arranged in the X direction at intervals of L, respectively. Further, the first ejection channels 61*a* and the second ejection channels 61*b* are shifted from each other in the X direction as much as a half of the interval L.

In contrast, similarly to the relationship between the first ejection channels 61*a* and the second ejection channels 61*b*, the third ejection channels 61*c* and the fourth ejection channels 61*d* are shifted from each other in the X direction as much as a half of the interval L. Further, the second ejection channels 61*b* and the third ejection channels 61*c* are shifted from each other in the X direction as much as a quarter of the interval L. As a result, the ejection channels 61*a* through 61*d* are arranged in the X direction at intervals of (¼)L, and it is possible to make the recording density four times as high as the case of a signal channel row.

On the lower surface LS of the actuator plate 52, the ejection channels 61*a* through 61*d* short in length in the Y direction and the non-ejection channels 62*a* through 62*d* long in length in the Y direction are arranged alternately in the X direction to constitute the channel rows 63 through 66, respectively. Thus, the first opening H1 formed in the actuator plate 52 is located at the center in the Y direction of the actuator plate 52.

As shown in FIG. 4, on both side surfaces in the X direction of each of the ejection channels 61*a* through 61*d* and the non-ejection channels 62*a* through 62*d*, there are formed drive electrodes 68. The dimension of the drive electrode 68 in the Z direction from the lower surface LS is set to roughly a half of the thickness of the actuator plate 52.

On the lower surface LS of the actuator plate 52, there are formed terminal electrodes 69 so as to correspond respectively to the channel rows 63 through 66.

Regarding the first channel row 63, the terminal electrode 69 is formed in the vicinity of the side surface facing to the Y direction of the actuator plate 52. The terminal electrode 69 includes a common terminal electrode electrically connected to the drive electrodes 68 (see FIG. 4) located on the both side surfaces of the first ejection channel 61*a*, and an individual terminal electrode (both not shown) electrically connected to each of the drive electrodes 68 on the side surfaces of the two first non-ejection channels 62*a* sandwiching the first ejection channel 61*a*.

It should be noted that the individual terminal electrode is formed along the side surface facing to the Y direction of the actuator plate 52. In contrast, the common terminal electrode is formed on the first ejection channel 61*a* side of the individual terminal electrode.

Regarding the second channel row 64, the terminal electrode 69 is formed in the vicinity of the side surface of the first opening H1. The terminal electrode 69 includes a common terminal electrode electrically connected to the drive electrodes 68 (see FIG. 4) located on the both side surfaces of the second ejection channel 61*b*, and an individual terminal electrode (both not shown) electrically connected to each of the drive electrodes 68 on the side surfaces of the two second non-ejection channels 62*b* sandwiching the second ejection channel 61*b*.

It should be noted that the individual terminal electrode here is formed along the first opening H1. In contrast, the common terminal electrode is formed on the second ejection channel 61*b* side of the individual terminal electrode. Further, the terminal electrodes 69 related to the third channel row 65 and the fourth channel row 66 are also provided with substantially the same configuration.

On the lower surface LS of the actuator plate 52, exposed areas 52*a* exposed from the nozzle plate 51 are disposed at four places. The exposed areas 52*a* at the four places are the areas corresponding respectively to the channel rows 63 through 66 in which the terminal electrodes 69 are formed on the lower surface LS of the actuator plate 52. Specifically, the exposed areas 52*a* are disposed at the both end parts in the Y direction, and end parts on both sides in the Y direction sandwiching the first opening H1 on the lower surface LS of the actuator plate 52.

Cover Plate

As shown in FIG. 3 and FIG. 4, the cover plate 53 is provided with a plate-like shape bonded on the upper surface US of the actuator plate 52 so as to block the channel rows 63 through 66. The cover plate 53 is provided with a second opening H2 formed at the center in the Y direction, first and second entrance side common ink chambers 90*a*, 90*b*, and first through fourth exit side common ink chambers 91*a* through 91*d*. The second opening H2 and the common ink chambers 90*a*, 90*b*, 91*a* through 91*d* are each formed as a slit extending in the cover plate 53 along the X direction.

The first entrance side common ink chamber 90*a* is communicated with end parts on the second channel row 64 side of the first ejection channels 61*a* included in the first channel row 63, and end parts on the first channel row 63 side of the second ejection channels 61*b* included in the second channel row 64. Further, the first exit side common ink chamber 91*a* is communicated with the other end parts of the first ejection channels 61*a*. Further, the second exit side common ink chamber 91*b* is communicated with the other end parts of the second ejection channels 61*b*.

In contrast, the second entrance side common ink chamber 90*b* is communicated with end parts on the fourth channel row 66 side of the third ejection channels 61*c* included in the third channel row 65, and end parts on the third channel row 65 side of the fourth ejection channels 61*d* included in the fourth channel row 66. Further, the third exit side common ink chamber 91*c* is communicated with the other end parts of the third ejection channels 61*c*. Further, the fourth exit side common ink chamber 91*d* is communicated with the other end parts of the fourth ejection channels 61*d*.

Flow Channel Plate

As shown in FIG. 4 in detail, the flow channel plate 54 is bonded to a principal surface of the cover plate 53 on the opposite side to the actuator plate 52. The flow channel plate 54 is provided with a supply flow channel 95, an exhaust flow channel 96, and a third opening H3. The third opening H3 is formed as a slit extending in the flow channel plate 54 along the X direction. The supply flow channel 95 is communicated with the liquid supply pipe 21 (see FIG. 2) of the liquid circulator 6, and at the same time communicated with the entrance side common ink chambers 90*a*, 90*b* of the cover plate 53. The exhaust flow channel 96 is communicated with the liquid exhaust pipe 22 (see FIG. 2) of the liquid circulator 6, and at the same time communicated with the first through fourth exit side common ink chambers 91*a* through 91*d*. In other words, the ink is supplied from the supply flow channel 95 to the actuator plate 52, and the ink is exhausted from the exhaust flow channel 96.

Nozzle Plate

As shown in FIG. 3 and FIG. 4, the nozzle plate 51 is a plate formed of a plate-like member (a sheet member) made of polyimide or the like with the thickness of about 50 μm to have a rectangular plate-like shape elongated in the X direction so as to correspond to the shape of the actuator plate 52. The nozzle plate 51 is attached to the lower surface LS of the actuator plate 52 by bonding or the like. The nozzle plate 51 has nozzle rows (first through fourth nozzle rows 72 through 75 indicated by the arrows in FIG. 3) each having a plurality of nozzle holes 71 (the jet orifices) communicated with the respective ejection channels 61, and arranged along the X direction. It should be noted that the nozzle plate 51 can also be formed of a resin material other than polyimide, a metal material, or the like.

Further, the nozzle plate 51 is made narrower in width in the Y direction than the actuator plate 52. Thus, the nozzle plate 51 exposes four terminal forming areas corresponding respectively to the channel rows 63 through 66 in which the terminal electrodes 69 are formed on the lower surface LS of the actuator plate 52 as the exposed areas 52*a* described above.

Circuit Board

To the exposed areas 52*a* in the lower surface LS of the actuator plate 52, upper surfaces of circuit boards 80 are respectively attached. Each of the circuit boards 80 is a flexible printed board, and is bonded to the actuator plate 52 by thermo-compression bonding via an anisotropic conductive film (ACF) not shown.

The thermo-compression bonding of the circuit boards 80 is carried out in a range of, for example, about 160° C. through 200° C. Among the four circuit boards 80, the circuit board 80 attached to the exposed area 52*a* along the side surface of the first opening H1 is drawn upward through the first through third openings H1 through H3. It should be noted that bonding between the actuator plate 52 and the circuit board 80 can also be achieved using an electrically-conductive adhesive or the like.

Base Plate

Figure 5:
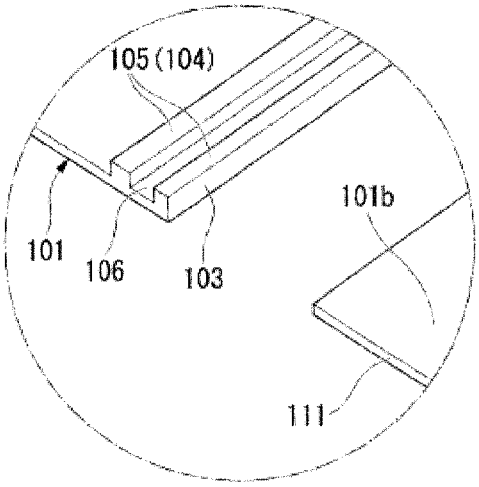
FIG. 5 is an enlarged view of the V part in FIG. 3.

FIG. 5 is an enlarged view of the V part in FIG. 3.

As shown in FIG. 3 through FIG. 5, the base plate 100 is formed of metal such as stainless steel. The base plate 100 is formed so as to cover the head chip 50 from below the nozzle plate 51. Specifically, the base plate 100 is obtained by integrating a nozzle guard 101 (a jet orifice guard) and a peripheral wall section 102 using, for example, bonding or welding, wherein the nozzle guard 101 has a plate-like shape disposed so as to cover the nozzle plate 51 and the actuator plate 52 from the lower surface side of the nozzle plate 51, and the peripheral wall section 102 erects from the outer peripheral part of the nozzle guard 101.

The nozzle guard 101 is a plate formed to have a rectangular plate-like shape elongated in the X direction so as to correspond to the shape of the actuator plate 52. The nozzle guard 101 is attached to the lower surface of the head chip 50 via the bonding layer 55 formed of an adhesive. In other words, the nozzle guard 101 is attached to the lower surface of the nozzle plate 51 and the exposed areas 52*a* in the lower surface LS of the actuator plate 52 with the adhesive. On the upper surface (the surface on the nozzle plate 51 side) of the nozzle guard 101, in most of the area except the place where the peripheral wall section 102 is erected and bolt pedestal installation surfaces 101*a* located on both sides in the X direction, there is formed a recess 101*b* via a step. On the bolt pedestal installation surfaces 101*a*, there are erected bolt pedestals 107, 108 described later.

In the recess 101*b*, opening sections 103 for exposing the nozzle holes 71 of the first through fourth nozzle rows 72 through 75 downward are formed respectively in the places corresponding to the first through fourth nozzle rows 72 through 75 of the nozzle plate 51. Each of the opening sections 103 is formed to have an oval shape elongated in the X direction.

Further, the recess 101*b* of the nozzle guard 101 has non-contact sections 111 each continuing throughout an area from a place opposed to the exposed area 52*a* of the actuator plate 52 to the opening section 103, and alignment sections 104 used for carrying out the alignment between the nozzle plate 51 and the nozzle guard 101.

The non-contact section 111 is a part between the part opposed to the exposed area 52*a* of the actuator plate 52 and the opening section 103 in the nozzle guard 101. The non-contact sections 111 are each opposed to the actuator plate 52 across the bonding layer 55. The non-contact sections 111 are formed so as not to have contact with the head chip 50.

The alignment section 104 is disposed on the opposite side to the non-contact section 111 across the opening section 103. The alignment section 104 is projection sections 105 projecting upward from the bottom surface of the recess 101*b* toward the nozzle plate 51, and having contact with the nozzle plate 51. The projection sections 105 are each formed to have a rib-like shape continuously extending along an inner circumferential edge of the opening section 103. Specifically, the projection sections 105 are formed in a half area obtained by dividing the inner circumferential edge of each of the opening sections 103 in the Y direction. There is disposed a plurality of lines (two lines in the present embodiment) of projection sections 105. The projection sections 105 are disposed at a distance. The projection height of the projection sections 105 is set to the same value. Further, the projection height of the projection sections 105 is set to the height with which the tip of each of the projection sections 105 and the bolt pedestal installation surfaces 101*a* are located on the same plane. Further, the tip of each of the projection sections 105 has contact with the nozzle plate 51. On this occasion, a groove section 106 formed between the projection sections 105 functions as a reservoir for the surplus adhesive.

The peripheral wall section 102 erecting from the outer peripheral part of the nozzle guard 101 is provided with rectangular bolt pedestals 107 located on the inner peripheral surface side (on the bolt pedestal installation surfaces 101*a*) of the four corners. Further, at the center of each of the bolt pedestal installation surfaces 101*a*, there is disposed a central bolt pedestal 108 so as to project from the peripheral wall section 102. These bolt pedestals 107, 108 are each formed to have a roughly square pillar shape. The bolt pedestals 107, 108 are respectively provided with through holes 107*a*, 108*a* penetrating in the Z direction. To each of the through holes 107*a*, 108*a*, there is inserted a bolt not shown. Further, via the volts, the nozzle guard 101 is fastened and fixed to an attachment member not shown attached to the carriage 33 (see FIG. 1).

Further, the pair of central bolt pedestals 108 are each provided with an X-direction alignment dowel 109 projecting in the X direction from the opposed surface formed integrally. The distance between these two X-direction alignment dowels 109 is set to be roughly equal to or slightly longer than the length in the X direction of the actuator plate 52. Therefore, there is achieved the alignment in the X direction of the actuator plate 52 housed inside the nozzle guard 101 with respect to the nozzle guard 101 with the X-direction alignment dowels 109.

Further, the X-direction alignment dowels 109 are formed so that the position of the tip is located on approximately the peripheral edge of the recess 101*b*, namely on approximately the boundary line between the bolt pedestal installation surface 101*a* and the recess 101*b*. Therefore, the actuator plate 52 housed in the nozzle guard 101 becomes in the state in which the sides on the both ends in the X direction roughly overlap the peripheral edge of the recess 101*b* viewed from the X direction.

Further, on the inner side surfaces on the both sides in the Y direction of the peripheral wall section 102, in the vicinity of each of the rectangular bolt pedestals 107 on the four corners, there is integrally formed a Y-direction alignment dowel 110. In the detailed description of the position of the Y-direction alignment dowel 110, the Y-direction alignment dowel 110 is disposed so that the position of the side surface located on the rectangular bolt pedestal 107 side is located at roughly the same position as the position of the tip of the X-direction alignment dowel 109 viewed from the Y direction.

The distance between the Y-direction alignment dowels 110 opposed to each other in the Y direction is set to be roughly equal to or slightly longer than the length in the Y direction of the actuator plate 52. Therefore, there is achieved the alignment in the Y direction of the actuator plate 52 housed inside the nozzle guard 101 with respect to the nozzle guard 101 with the Y-direction alignment dowels 110.

Bonding Layer

As shown in FIG. 4, the bonding layer 55 is disposed between the actuator plate 52 including at least the exposed area 52*a* and the nozzle guard 101 and bonds the actuator plate 52 and the nozzle guard 101 to each other. Specifically, the bonding layer 55 is disposed between the exposed areas 52*a* of the actuator plate 52 and the nozzle guard 101, and between the nozzle plate 51 and the nozzle guard 101. It should be noted that the bonding layer 55 located between the non-contact sections 111 and the head chip 50 extends from the positions corresponding to the exposed areas 52*a* toward the opening sections 103 up to the positions short of the inner circumferential edges of the opening sections 103 in the example illustrated, but can extend up to the inner circumferential edges of the opening sections 103. It should be noted that from the viewpoint of preventing the adhesive constituting the bonding layer 55 from flowing into the opening sections 103, it is preferable to adopt the configuration in which the bonding layer 55 extends up to the positions short of the inner circumferential edges of the opening sections 103 as shown in the drawing.

Operation of Liquid Jet Recording Device

Then, the case of recording a character, a figure, or the like on the recording medium P using the liquid jet recording device 1 will be described.

It should be noted that it is assumed as an initial state that inks different in color from each other are sufficiently encapsulated in the four liquid containers 4 shown in FIG. 1, respectively. Further, it is assumed that there is achieved the state in which the liquid jet heads 5 are filled with the inks in the liquid containers 4 via the liquid circulators 6, respectively.

In such an initial state, when operating the liquid jet recording device 1, the grit rollers 11, 13 of the conveyers 2, 3 rotate to thereby convey the recording medium P between the grit rollers 11, 13 and the pinch rollers 12, 14 toward the conveying direction (the X direction). Further, at the same time as this operation, the drive motor 38 rotates the pulleys 35, 36 to move the endless belt 37. Thus, the carriage 33 reciprocates in the Y direction while being guided by the guide rails 31, 32.

Further, by appropriately ejecting the four colors of inks on the recording medium P from the liquid jet heads 5 during this operation, it is possible to carry out recording of a character, a figure, and so on.

Here, the action of each of the liquid jet heads 5 will hereinafter be described.

Among such side-shooting types as in the present embodiment, in the circulation type liquid jet head 5, firstly, by operating the pressure pump 24 and the suction pump 25 shown in FIG. 2, the ink is circulated in the circulation flow channel 23. In this case, the ink circulating through the liquid supply pipe 21 passes through the entrance side common ink chambers 90*a*, 90*b* via the supply flow channel 95, and is supplied in the ejection channels 61 of each of the channel rows 63 through 66.

Further, the ink in each of the ejection channels 61 flows into each of the exit side common ink chambers 91*a* through 91*d*, and is then exhausted to the liquid exhaust pipe 22. The ink exhausted to the liquid exhaust pipe 22 is returned to the liquid container 4, and is then supplied to the liquid supply pipe 21 again. Thus, the ink is circulated between the liquid jet head 5 and the liquid container 4.

Then, when the reciprocation is started by the carriage 33 (see FIG. 1), the controller not shown applies a drive voltage to the drive electrodes 68 via the circuit board 80. Then, a thickness shear deformation occurs in a drive wall (the actuator plate 52) partitioning the ejection channels 61, and the capacity in the ejection channel 61 varies. Thus, the internal pressure in the ejection channel 61 increases to pressure the ink. As a result, the ink shaped like a droplet is ejected to the outside through the nozzle hole 71 to thereby record the character, the figure, or the like on the recording medium P.

Here, the nozzle plate 51 and the actuator plate 52 constituting the head chip 50 are different in material from each other. Therefore, due to the difference in expansion deformation amount and contraction deformation amount caused by the heat variation, a warpage occurs in the actuator plate 52 when a change in temperature occurs. In particular, since the exposed areas 52*a* of the actuator plate 52 are located at end parts of the actuator plate 52, the displacement due to the warpage becomes large.

According to the present embodiment, since the bonding layer 55 is disposed between the exposed areas 52*a* of the actuator plate 52 and the nozzle guard 101, it is possible to prevent the exposed areas 52*a*, which is not reinforced by the nozzle plate 51, and is therefore weak against the deformation, from having direct contact with the nozzle guard 101 to be damaged when the actuator plate 52 warps.

Moreover, since the nozzle guard 101 has the non-contact section 111 continuing throughout the area from the place opposed to the exposed area 52*a* of the actuator plate 52 to the inner circumferential edge of the opening section 103, and opposed to the actuator plate 52 across the bonding layer 55, it is possible to release the stress, which is applied to the bonding layer 55 when the actuator plate 52 warps, toward the inner peripheral edge of the opening section 103. Therefore, it is possible to release the stress in the exposed area 52*a*, which is caused by the warpage of the actuator plate 52, through the bonding layer 55, and it is possible to prevent the exposed areas 52*a* of the actuator plate 52 from being damaged.

Further, the nozzle guard 101 has the alignment section 104 disposed on the opposite side to the non-contact section 111 across the opening section 103, and carrying out the alignment between the nozzle plate 51 and the nozzle guard 101. Thus, it is possible to accurately determine the position of the nozzle holes 71 with respect to the nozzle guard 101 while preventing the increase in stress of the actuator plate 51 due to the restriction of the expansion/contraction deformation of the bonding layer 55 disposed between the non-contact section 111 and the actuator plate 52. Therefore, it is possible to prevent the degradation of the quality of the character and the figure recorded on the recording medium P.

According to the configuration described above, it is possible to prevent the damage of the actuator plate 52 without degrading the quality of the character and the figure recorded on the recording medium P.

Further, since the projection sections 105 project toward the nozzle plate 51 to have contact with the nozzle plate 51, it is possible to carry out the alignment between the nozzle plate 51 and the nozzle guard 101 as the alignment section 104.

Further, since the projection sections 105 extend along the inner circumferential edge of the opening section 103, it is possible to restrict the flow of the material constituting the bonding layer 55 to thereby prevent the material from flowing into the opening section 103. Further, since the plurality of projection sections 105 is disposed, it is possible to reserve the material constituting the bonding layer 55 between the projection sections 105, and it is possible to more reliably prevent the material constituting the bonding layer 55 from flowing into the opening section 103.

Second Embodiment

Then, a liquid jet head according to a second embodiment will be described.

Figure 6:
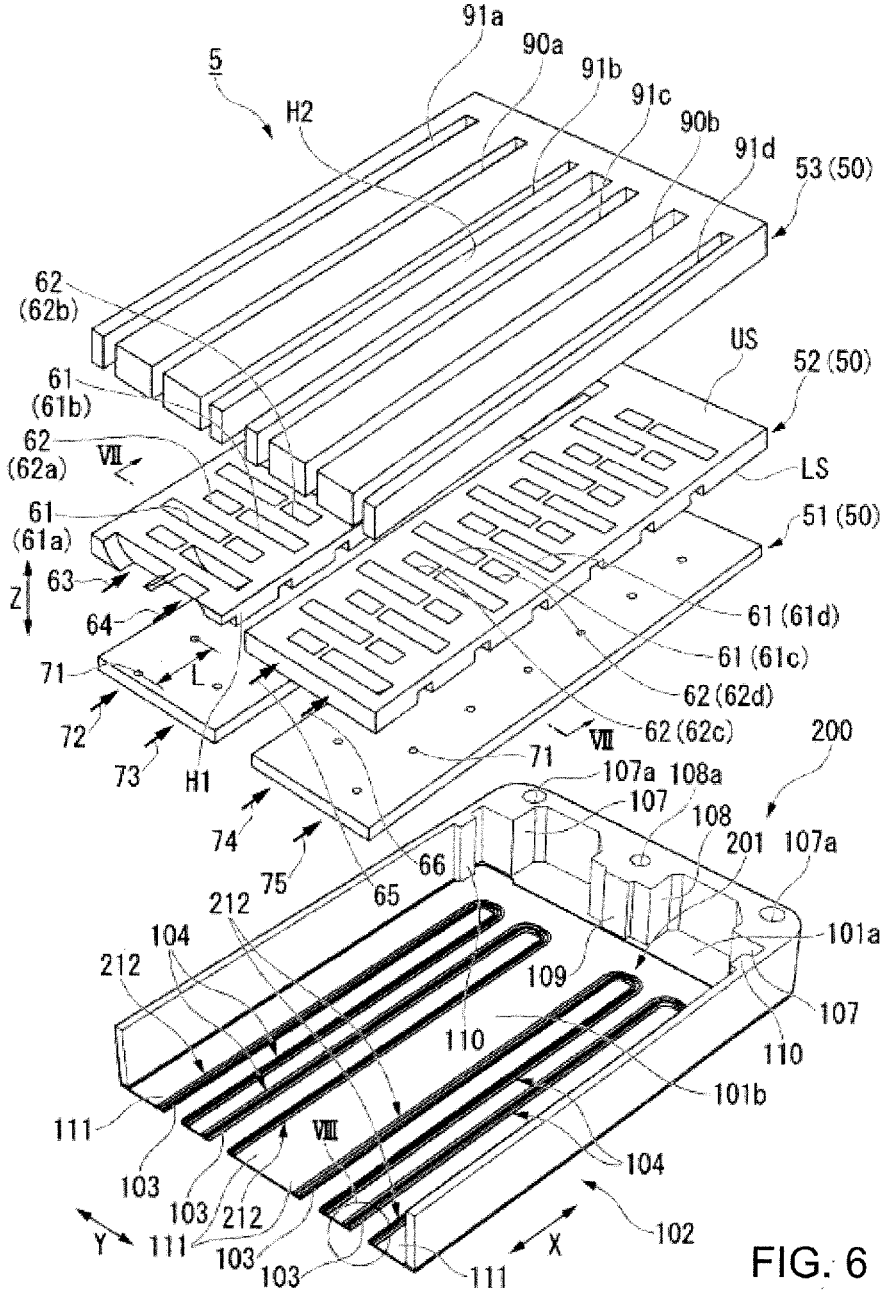
FIG. 6 is an exploded perspective view of a liquid jet head according to a second embodiment of the invention.
Figure 7:
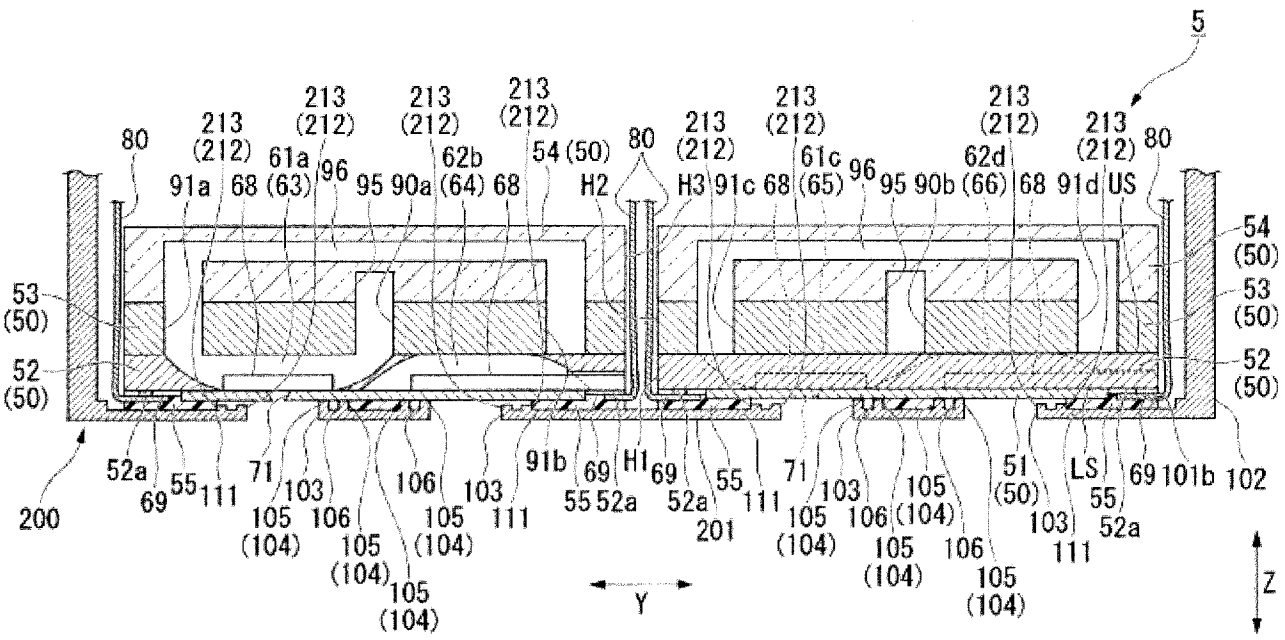
FIG. 7 is a cross-sectional view of the liquid jet head according to the second embodiment.
Figure 8:
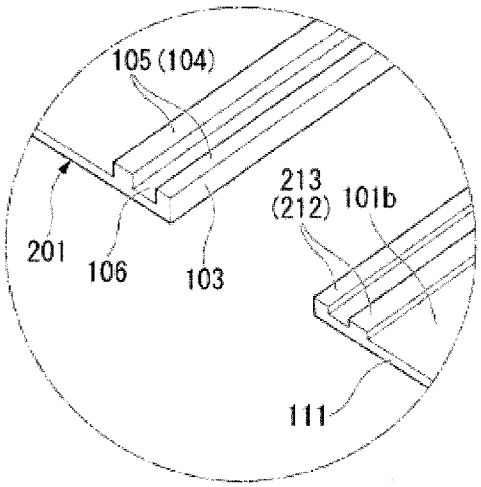
FIG. 8 is an enlarged view of the VIII part in FIG. 6.

FIG. 6 is an exploded perspective view of the liquid jet head according to the second embodiment. FIG. 7 is an explanatory diagram of the liquid jet head according to the second embodiment, and is a diagram corresponding to a cross-section along the line VII-VII in FIG. 6 in the assembled state of the liquid jet head. FIG. 8 is an enlarged view of the VIII part in FIG. 6.

The second embodiment shown in FIG. 6 through FIG. 8 is different from the first embodiment shown in FIG. 3 through FIG. 5 in the point that the non-contact section 111 of a nozzle guard 201 is provided with a blocking section 212. It should be noted that the constituents substantially the same as those of the first embodiment shown in FIG. 3 through FIG. 5 are denoted by the same reference symbols, and the detailed description thereof will be omitted (the same applies to the following embodiments).

As shown in FIG. 6 through FIG. 8, a base plate 200 is obtained by integrating the nozzle guard 201 and the peripheral wall section 102 with each other. The non-contact section 111 of the nozzle guard 201 is provided with the blocking section 212 for preventing the bonding layer 55 from flowing into the opening section 103. The blocking section 212 is formed of protruding sections 213 projecting upward toward the nozzle plate 51. The protruding sections 213 are formed to have a rib-like shape extending along the inner circumferential edge of the opening section 103. Specifically, the protruding sections 213 extend along the entire range where the projection sections 105 are not formed out of the inner circumferential edge of the opening section 103. There is disposed a plurality of lines (two lines in the present embodiment) of protruding sections 213. The protruding sections 213 are disposed with a distance. The projection height of the protruding sections 213 is set to the same value, and at the same time, lower than the projection height of the projection sections 105. Thus, the protruding sections 213 are separated from the nozzle plate 51.

As described above, in the present embodiment, the non-contact section 111 is provided with the protruding sections 213 projecting toward the nozzle plate 51 as the blocking section 212 for preventing the bonding layer 55 from flowing into the opening section 103. Thus, in bonding the actuator plate 52 and the nozzle guard 201 to each other, it is possible to restrict the flow of the adhesive constituting the bonding layer 55 by the protruding sections 213 to prevent the adhesive from flowing into the opening section 103. Therefore, it is possible to prevent the nozzle holes 71 exposed in the opening section 103 from being blocked by the adhesive. Therefore, it is possible to prevent the degradation of the quality of the character and the figure recorded on the recording medium P.

It should be noted that although the plurality of lines of protruding sections 213 is provided in the present embodiment, besides this configuration, it is also possible to provide a single line of the protruding section 213 alone. It should be noted that from the viewpoint that the adhesive can be reserved between the protruding sections 213, it is preferable to provide the plurality of protruding sections 213.

Third Embodiment

Then, a liquid jet head according to a third embodiment will be described.

Figure 9:
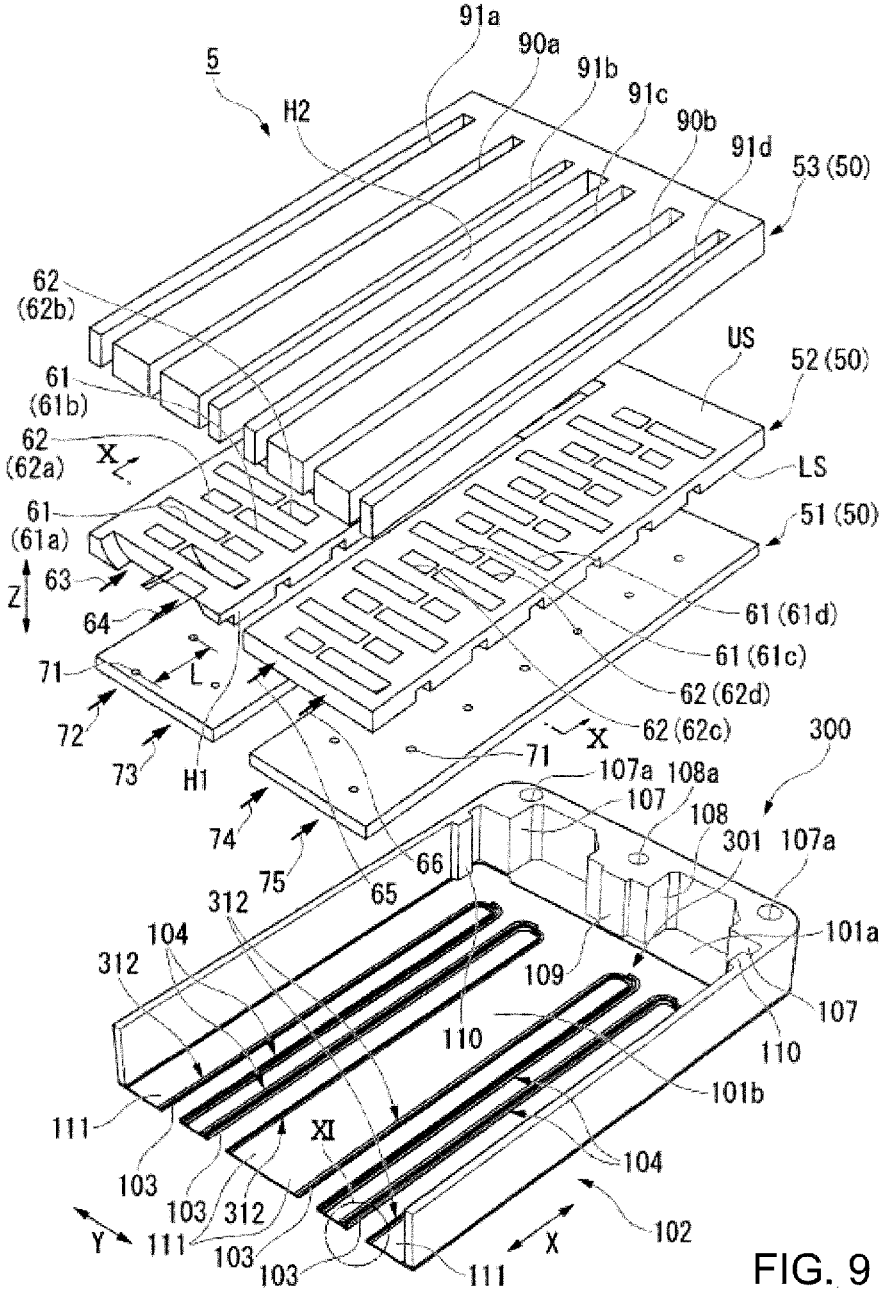
FIG. 9 is an exploded perspective view of a liquid jet head according to a third embodiment of the invention.
Figure 10:
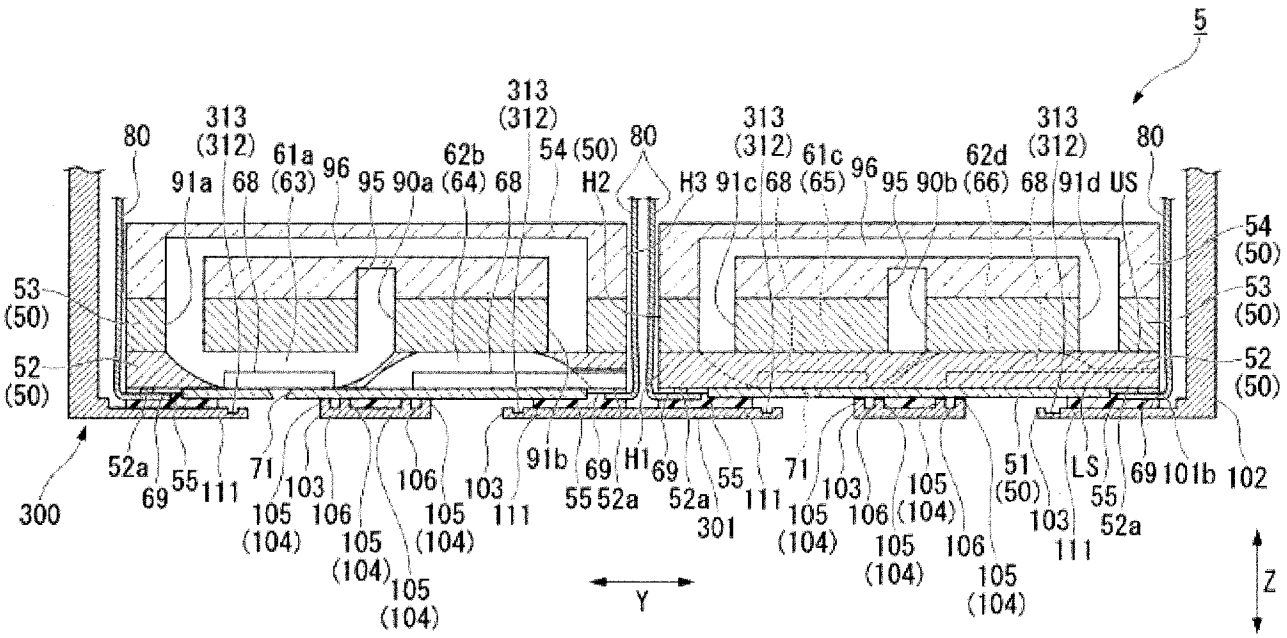
FIG. 10 is a cross-sectional view of the liquid jet head according to the third embodiment.
Figure 11:
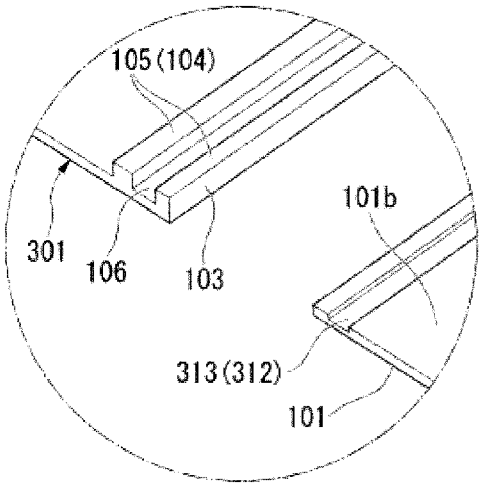
FIG. 11 is an enlarged view of the XI part in FIG. 9.

FIG. 9 is an exploded perspective view of the liquid jet head according to the third embodiment. FIG. 10 is an explanatory diagram of the liquid jet head according to the third embodiment, and is a diagram corresponding to a cross-section along the line X-X in FIG. 9 in the assembled state of the liquid jet head. FIG. 11 is an enlarged view of the XI part in FIG. 9.

In the second embodiment shown in FIG. 6 through FIG. 8, the blocking section 212 provided to the non-contact section 111 of the nozzle guard 201 is the protruding sections 213. In contrast, the third embodiment shown in FIG. 9 through FIG. 11 is different from the second embodiment in the point that a blocking section 312 provided to the non-contact section 111 of a nozzle guard 301 is a recessed section 313.

As shown in FIG. 9 through FIG. 11, a base plate 300 is obtained by integrating the nozzle guard 301 and the peripheral wall section 102 with each other. The non-contact section 111 of the nozzle guard 301 is provided with the blocking section 312 for preventing the bonding layer 55 from flowing into the opening section 103. The blocking section 312 is the recessed section 313 provided to the non-contact section 111. The recessed section 313 is formed to have a groove shape extending along the inner circumferential edge of the opening section 103. Specifically, the recessed section 313 extends along the entire range where the projection sections 105 are not formed out of the inner circumferential edge of the opening section 103.

As described above, in the present embodiment, the non-contact section 111 is provided with the recessed section 313 as the blocking section 312 for preventing the bonding layer 55 from flowing into the opening section 103. Thus, in bonding the actuator plate 52 and the nozzle guard 301 to each other, it is possible to reserve the adhesive, which constitutes the bonding layer 55, and flows, in the recessed section 313 to prevent the adhesive from flowing into the opening section 103. Therefore, it is possible to prevent the nozzle holes 71 exposed in the opening section 103 from being blocked by the adhesive. Therefore, it is possible to prevent the degradation of the quality of the character and the figure recorded on the recording medium P.

It should be noted that the invention is not limited to the above embodiment described with reference to the drawings, but a variety of modified examples can be cited within the scope or the spirit of the invention.

For example, in the embodiments described above, a so-called inkjet printer is cited in the description as an example of the liquid jet recording device 1. However, the invention is not limited to this example, and a facsimile machine, or an on-demand printing machine, for example, can also be adopted.

Further, in the embodiments described above, there is described the multi-color liquid jet recording device 1 provided with a plurality of liquid jet heads 5. However, the invention is not limited to this example, but it is also possible to adopt, for example, a single-color device having a single liquid jet head 5.

Further, in each of the embodiments described above, the alignment section 104 is the plurality of projection sections 105 having the rib-like shape, but the invention is not limited to this configuration, and it is also possible to provide a single line of the projection section alone having the rib-like shape. Further, the shape of the projection section is not limited to the rib-like shape extending continuously, but it is also possible to dispose the projection section in fragments. It should be noted that from the viewpoint of preventing the adhesive constituting the bonding layer 55 from flowing, it is preferable for the projection section to be formed to have the rib-like shape extending continuously.

Further, in the embodiments described above, there is described the case in which the liquid jet head 5 is of a so-called side-shooting type. However, the invention is not limited to this configuration, but it is also possible to apply the configuration of the base plate 100 according to the present embodiment to a so-called edge-shooting type liquid jet head for ejecting the ink from a nozzle hole disposed in one end in the longitudinal direction of a channel.

Further, in the embodiments described above, there is described the case of using the actuator plate 52 having a unique polarization direction along the thickness direction. However, the invention is not limited to this configuration, but it is also possible to use, for example, a so-called chevron type actuator plate obtained by stacking two piezoelectric bodies, which are different in polarization direction from each other, on one another.

Further, in the embodiments described above, there is described the four-row type inkjet head having the four nozzle rows 72 through 75 arranged side by side. However, the invention is not limited to this configuration, and the number of the nozzle rows is not particularly limited.

Further, in the embodiments described above, the exposed areas exposed from the jet orifice plate in the actuator plate extends along the longitudinal direction (the X direction) of the actuator plate, but the invention is not limited to this configuration. It is also possible for the exposed areas of the actuator plate to be disposed on the both end parts in the longitudinal direction of the actuator plate, and extend along the short side direction (the Y direction) of the actuator plate.

Besides the above, it is arbitrarily possible to replace the constituent in the embodiment described above with a known constituent within the scope or the spirit of the invention.

What is claimed is:

1. A liquid jet head comprising:

a jet orifice plate provided with a jet orifice;

an actuator plate attached to one surface side of the jet orifice plate, having a plurality of channels communicated with the jet orifice, and provided with an exposed area exposed from the jet orifice plate;

a jet orifice guard disposed so as to cover the jet orifice plate and the actuator plate from the other surface side of the jet orifice plate, and provided with an opening section adapted to expose the jet orifice; and a bonding layer disposed at least between the actuator plate including the exposed area and the jet orifice guard, and adapted to bond the actuator plate and the jet orifice guard to each other, wherein the jet orifice guard includes a non-contact section continuing throughout an area from a place opposed to the exposed area to an inner circumferential edge of the opening section, and opposed to the actuator plate across the bonding layer, and an alignment section disposed on an opposite side to the non-contact section across the opening section, and adapted to carry out alignment between the jet orifice plate and the jet orifice guard.

2. The liquid jet head according to claim 1, wherein the non-contact section is provided with a blocking section adapted to prevent a material constituting the bonding layer from flowing into the opening section.

3. The liquid jet head according to claim 2, wherein the blocking section is a protruding section projecting toward the jet orifice plate.

4. The liquid jet head according to claim 2, wherein the blocking section is a recessed section provided to the jet orifice guard.

5. The liquid jet head according to claim 1, wherein the alignment section is at least one projection section projecting toward the jet orifice plate so as to have contact with the jet orifice plate.

6. The liquid jet head according to claim 5, wherein the plurality of projection sections extends along an inner circumferential edge of the opening section.

7. The liquid jet head according to claim 1, further comprising:

a cover plate disposed on an opposite side to the jet orifice plate across the actuator plate so as to block the plurality of channels; and a circuit board attached to the exposed area, wherein the channels and the jet orifice are communicated with each other in a central part in an extending direction of the plurality of channels.

8. A liquid jet recording device comprising:

the liquid jet head according to claim 1;

a conveyer adapted to move the liquid jet head and recording medium relatively to each other;

a liquid container containing a liquid; and a liquid circulator adapted to circulate the liquid between the liquid jet head and the liquid container.

* * * * *